US007234893B2

(12) United States Patent
Lyons

(10) Patent No.: US 7,234,893 B2
(45) Date of Patent: Jun. 26, 2007

(54) ROAD SURFACING MATERIAL OVER ROADWAY JOINTS, METHOD OF MANUFACTURING, AND METHOD USING THE SAME

(75) Inventor: Gregory M. Lyons, St. Catharines (CA)

(73) Assignee: Saint-Gobain Technical Fabrics Canada, Ltd, North Borouch, MA (US)

( * ) Notice: Subject to any disclaimer, the term of this patent is extended or adjusted under 35 U.S.C. 154(b) by 0 days.

(21) Appl. No.: 11/470,781

(22) Filed: Sep. 7, 2006

(65) Prior Publication Data

US 2007/0003367 A1 Jan. 4, 2007

Related U.S. Application Data

(62) Division of application No. 11/170,519, filed on Jun. 29, 2005, now Pat. No. 7,144,190.

(51) Int. Cl.
*E01C 5/22* (2006.01)

(52) U.S. Cl. ..... 404/72; 404/73; 404/75

(58) Field of Classification Search ..... 404/72, 404/73, 75

See application file for complete search history.

(56) References Cited

U.S. PATENT DOCUMENTS

| | | | | | |
|---|---|---|---|---|---|
| 3,430,544 | A * | 3/1969 | Berks | 14/73 |
| 3,810,707 | A * | 5/1974 | Tungseth et al. | 404/67 |
| 4,011,184 | A * | 3/1977 | van Reijendam et al. | 525/98 |
| 4,111,582 | A * | 9/1978 | Tippett | 404/47 |
| 4,653,956 | A * | 3/1987 | Lang | 404/28 |
| 4,876,759 | A * | 10/1989 | Yang | 14/73.1 |
| 5,020,294 | A * | 6/1991 | Duda | 52/396.07 |
| 5,024,554 | A * | 6/1991 | Benneyworth et al. | 404/74 |
| 5,092,094 | A * | 3/1992 | Duda et al. | 52/396.05 |
| 5,791,111 | A * | 8/1998 | Beenders | 52/396.05 |
| 5,799,456 | A * | 9/1998 | Shreiner et al. | 52/396.04 |
| 6,112,488 | A * | 9/2000 | Olson et al. | 52/393 |
| 6,235,136 | B1 * | 5/2001 | Kittson et al. | 156/166 |
| 6,666,618 | B1 * | 12/2003 | Anaya et al. | 404/68 |
| 6,751,918 | B2 * | 6/2004 | Jesko | 52/393 |
| 6,860,074 | B2 * | 3/2005 | Stanchfield | 52/464 |

* cited by examiner

*Primary Examiner*—Raymond Addie
(74) *Attorney, Agent, or Firm*—Duane Morris LLP

(57) ABSTRACT

A method of making a membrane assembly by forming at least a pair of bottom sheet membranes and at least one top sheet membrane, wherein the bottom sheet membranes are adapted to attach to and cover respective pavement sections of a roadway, and constructing each top sheet membrane with a track, wherein each track receives edges of a corresponding pair of the bottom sheet membranes.

5 Claims, 4 Drawing Sheets

ROAD SURFACING MATERIAL OVER ROADWAY JOINTS, METHOD OF MANUFACTURING, AND METHOD USING THE SAME

REFERENCE TO RELATED APPLICATIONS

This application is a Divisional application of U.S. Ser. No. 11/170,519 filed Jun. 29, 2005 now U.S. Pat. No. 7,144,190.

FIELD OF THE INVENTION

The invention relates to a construction of a road surfacing layer covering pavement sections of a roadway.

BACKGROUND

Pavement sections, for example, concrete slabs, of a roadway, undergo thermal movement, expansion and contraction, in response to ambient temperature changes and water permeated soil conditions. For example, thermal movement of concrete slabs in response to ambient temperature changes can be in excess of 8 mm. The slabs are purposely separated by expansion joints, which are gaps between the slabs. The gaps narrow and widen as the slabs undergo expansion and contraction. When the roadway is resurfaced, asphalt surfacing material is spread and compacted to form a continuous layer covering the slabs and the expansion joints. The gaps widen and narrow due to thermal movement of the pavement sections, which causes cracks to form in the road surfacing material. The ability of asphalt cement concrete, ACC, to withstand tensile stress is extremely limited. The gaps will penetrate through the asphalt, which causes cracks to form in the asphalt. The asphalt and the underlying pavement deteriorate quickly, especially in areas where water penetrates through cracks in the asphalt. Prior to the present invention, it was desirable to add a reinforcement membrane to the road surfacing material to deter cracks from forming.

U.S. Pat. No. 6,192,650 to Kittson et al., discloses a reinforced, asphalt-based membrane for reinforcing a road surfacing material. Numerous other membranes have been produced for small surface-area applications, such as in the patching of roads. Membranes have been proposed for reinforcing bituminous or asphalt based road surfacing materials. However, such membranes are poor in their ability to resist cracking of road surfacing material that has been applied directly over expansion joints in a concrete roadway. Accordingly, it would be advantageous to provide a road surfacing material with a more adequate membrane for resisting cracks due to underlying thermal movement of slabs separated by an expansion joint.

Another likely place for cracks to form is in a surface layer of road surfacing material that has been applied over gaps that begin as narrow crevices, as disclosed by U.S. Pat. No. 5,476,340. For example, the crevices develop in pavement sections, due to such causes as, bridge movement, earth movement and erosion. Thus, it would be desirable to cover expansion joints, crevices and other forms of gaps, with a membrane assembly. The membrane assembly would isolate the road surfacing material from movement of the pavement sections to resist cracks from forming in the road surfacing material.

SUMMARY OF THE INVENTION

The invention provides a membrane assembly for isolating road surfacing material from movement of pavement sections of a roadway. The membrane assembly advantageously deters the formation of cracks in the road surfacing material due expansion and contraction of the pavement sections.

According to an embodiment of the invention, the membrane assembly has at least a pair of bottom sheet membranes covered by a top sheet membrane, wherein the bottom sheet membranes are adapted to attach and cover respective pavement sections of a roadway, wherein the top sheet membrane is adapted to support road surfacing material thereon, while the top sheet membrane extends over a gap between the respective pavement sections, and wherein the bottom sheet membranes are slidable relative to the top sheet membrane in response to movement of the respective pavement sections.

According to a further embodiment of the invention, the membrane assembly includes a stress absorbing membrane covering the top sheet membrane to provide an underlayment beneath the road surfacing material.

According to a further embodiment of the invention, a method of installing road surfacing material is performed, by attaching bottom sheet membranes to respective pavement sections of a roadway, slidably assembling the bottom sheet membranes to a top sheet membrane, covering the bottom sheet membranes with the top sheet membrane, and installing a layer of road surfacing material over the top sheet membrane, while the top sheet membrane extends over a gap between the respective pavement sections.

According to a further embodiment of the invention, the method of installing road surfacing material is further performed by, covering the top sheet membrane with a stress absorbing membrane serving as an underlayment beneath the road surfacing material.

According to a further embodiment of the invention, a road surface layer has a layer of road surfacing material covering a membrane assembly, wherein the membrane assembly includes, a pair of bottom sheet membranes secured to respective pavement sections; and a top sheet membrane covering a gap between the respective pavement sections of the roadway, and wherein the bottom sheet membranes are slidable relative to the top sheet membrane in response to movement of the respective pavement sections.

Further, embodiments of the invention will be apparent by way of example from a following detailed description taken in conjunction with accompanying drawings.

DETAILED DESCRIPTION

Figure 1:
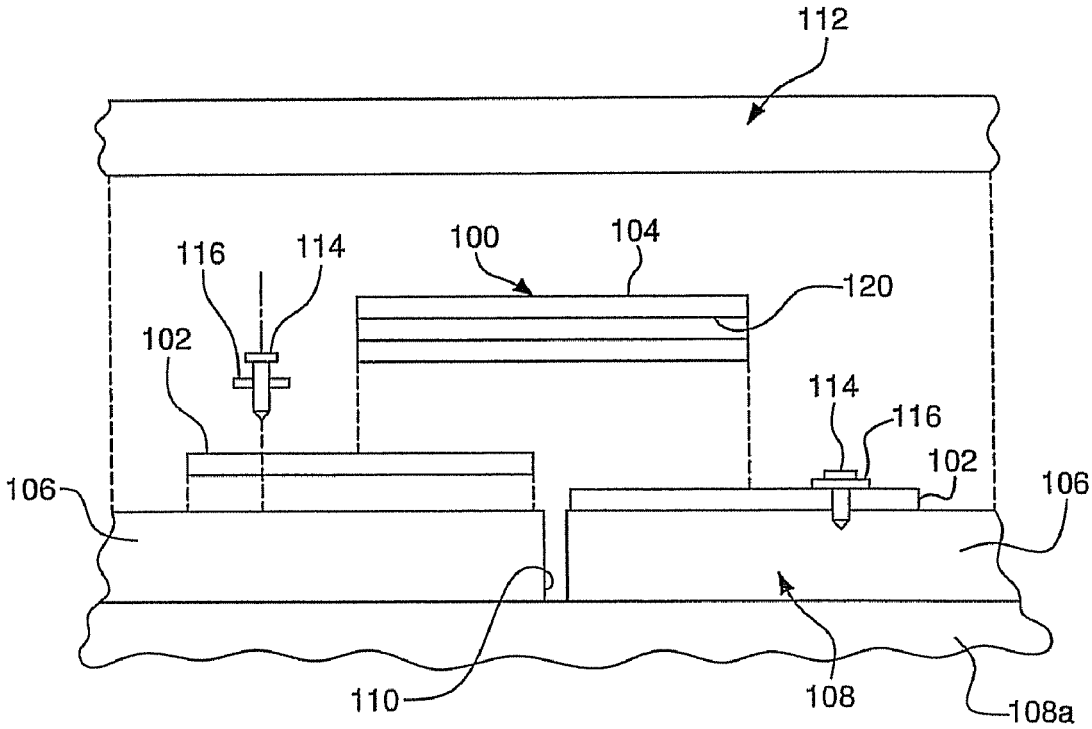
FIG. 1 is a fragmentary section view of separated parts of a membrane assembly and a roadway having a gap between pavement sections.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly,"etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

With reference to FIG. 1, the present invention provides a membrane assembly 100 having at least one pair of bottom sheet membranes 102, 102 and at least one top sheet membrane 104. The bottom sheet membranes 102, 102 are adapted to attach and cover respective pavement sections 106, 106 of a roadway 108. The roadway 108 is supported on an earthen or bridge span foundation 108*a*. The pavement sections 106, 106 are adjacent to a gap 110 that separates the pavement sections 106, 106 from each other. The gap 110 widens and narrows due to thermal contraction and expansion of the pavement sections 106. For example, the gap 110 comprises an expansion joint or, alternatively, a crevice that has developed between the pavement sections 106, 106. Further, the gap 110 includes, but is not limited to, an expansion joint, a crevice or a widened expansion joint having therein an expansion mechanism 200, as disclosed by FIG. 2. Further details of an exemplary expansion mechanism 200 are described in U.S. Pat. No. 6,666,618.

Figure 2:
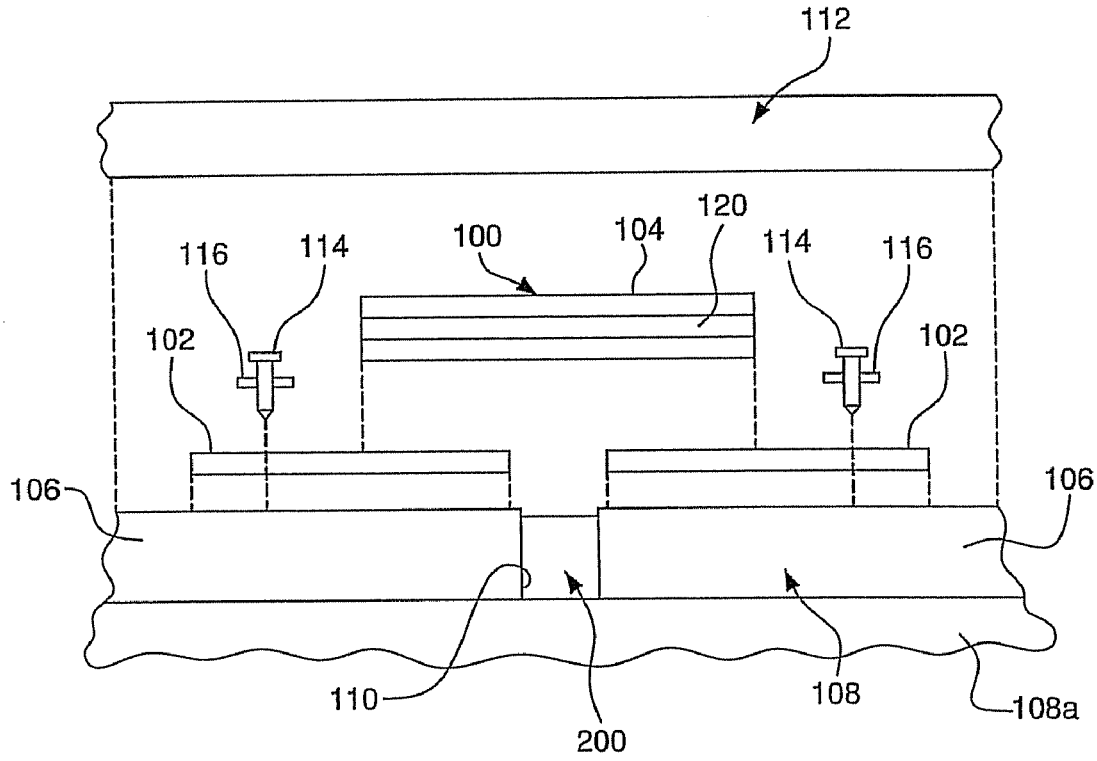
FIG. 2 is a fragmentary section view of separated parts of a membrane assembly and a roadway having pavement sections of a roadway and an expansion joint filled by an expansion device.

FIGS. 1 and 2 disclose that, to attach the bottom sheet membranes 102, 102 to the respective pavement sections 106, 106, stainless steel pin fasteners 114 are driven into the bottom sheet membranes 102, 102 to imbed in the pavement sections 106, 106. The pin fasteners 114 have captive, enlarged washers 116 thereon. The washers 116 distribute the stresses applied by the pin fasteners 114, and further lodge under enlarged heads of the pin fasteners 114 to prevent their passage through the bottom sheet membranes 102, 102. For example, the pin fasteners 114 are commercially available under the brand name, X-CR™ Pins, a trademark of Hilti Corporation, FL-9494 Schaan, Principality of Liechtenstein. The X-CR™ Pins are part of a fastener system including pin driving, pneumatic or powder actuated hammer tools supplied by Hilti, Inc., P.O. Box 21148, Tulsa, Okla. 74121 USA.

Figure 1A:
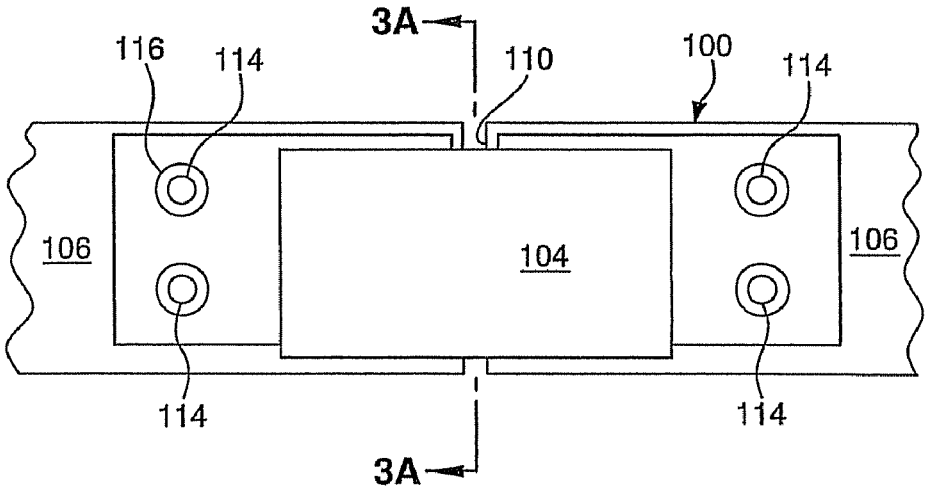
FIG. 1A is a fragmentary top view of the membrane assembly and the roadway disclosed by FIG. 1.

FIG. 1A discloses that the membrane 100 has at least one top sheet membrane 104 adapted to extend over and across the gap 110. Further, the one top sheet membrane 104 extends over and across the expansion joint device 200 that may be present in the gap 110. The span of the one top sheet membrane 104 extends continuously across the gap, and substantially covers the corresponding pair of bottom sheet membranes 102, 102. FIG. 4 discloses an alternative embodiment of a membrane 100 having more than one top sheet membrane 104. Each top sheet membrane 104 substantially covers at least one pair of bottom sheet membranes 102, 102. Further, FIG. 4 discloses an alternative embodiment of a membrane 100 having more than one pair of bottom sheet membranes 102.

Figure 3A:
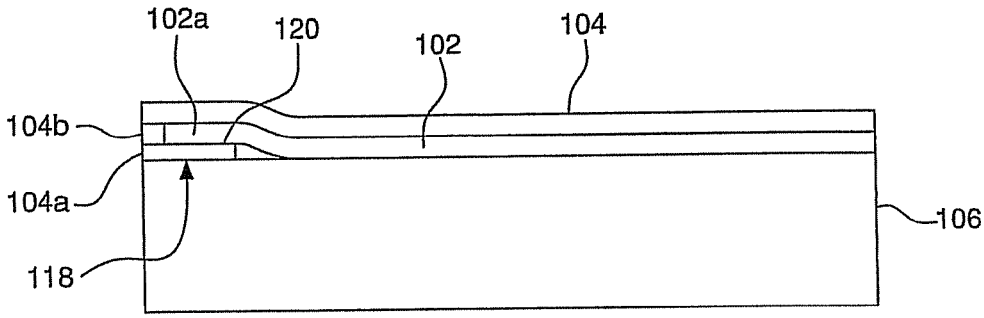
FIG. 3A is a section view taken along the line 3A—3A in FIG. 1.
Figure 4A:
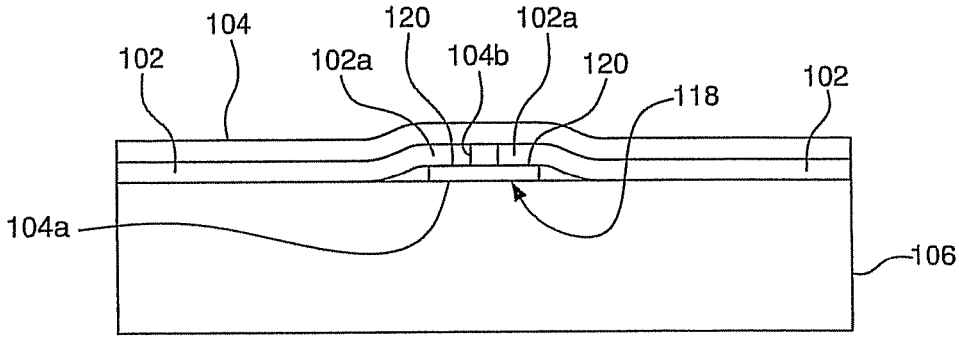
FIG. 4A is a section view taken along the line 4A—4A of FIG. 4.
Figure 4:
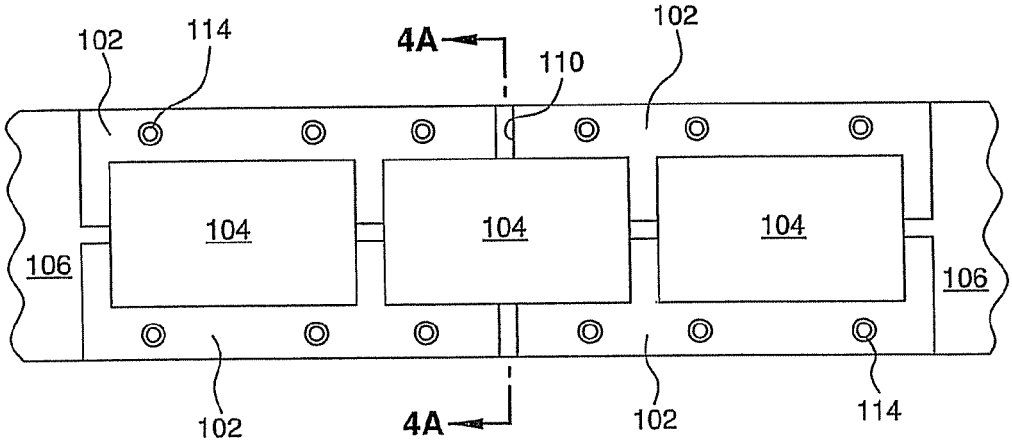
FIG. 4 is a fragmentary top view of another embodiment of a membrane assembly and a roadway.

In each of FIGS. 3A and 4A, each top sheet membrane 104 has a track 118. A corresponding pair of bottom sheet membranes 102, 102 is slidably coupled to each track 118 for movement that is confined along each track 118, as the bottom sheet membranes, 102, 102 move with expansion and contraction of respective pavement sections 106, 106. The track 118 has at least one channel 120 that opens laterally. The channel 120 slidably receives respective edges 102*a*, 102*a* of the bottom sheet membranes 102, 102. The track 118 is made by, a flat bottom strip 104*a* attached to a flat, narrow neck portion 104*b* that extends toward a bottom surface 104*c* of the top sheet membrane 104. The narrow neck portion 104*b* is comprised of a sheet membrane of similar composition as the top sheet membrane 104. The bottom strip 104*a* is comprised of a sheet membrane, of similar composition as the top sheet membrane 104. The bottom strip 104*a* extends over and across the gap 110, and extends over and across the expansion joint device 200 that may be present in the gap 110.

A preferred method of attaching the strip 104*a* and the narrow neck portion 104*b* to the bottom surface 104*c* is, to bond them, by applying heat and pressure to melt and bond together the polymeric rovings of the strip 104*a* and the narrow neck portion 104*b*. Alternatively, adherent surfaces on the strip 104*a* and the narrow neck portion 104*b* are formed, for example, by adherent surfaces on the strip 104*a* and narrow neck portion 104*b* that bond together and attach to the bottom surface 104*c* of the top sheet membrane 104.

Figure 3B:
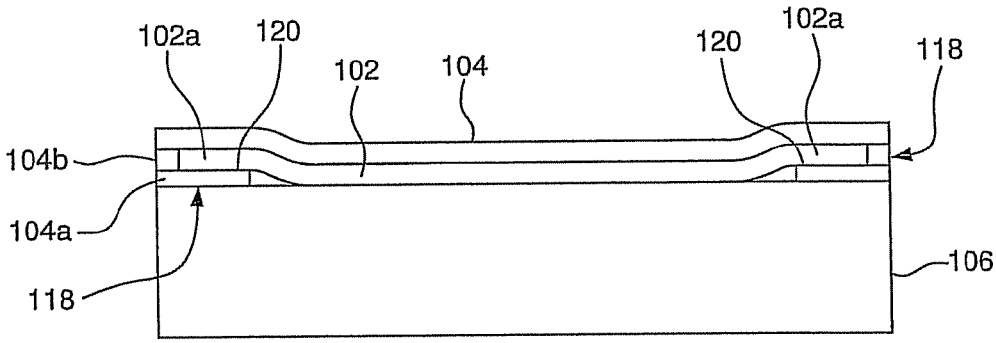
FIG. 3B is a view similar to FIG. 3A, disclosing an alternative embodiment of a membrane assembly.

In FIG. 3A, at least one track 118 can extend along an edge of a corresponding top sheet membrane 104. Alternatively, in FIG. 4, at least one track 118 can extend along a midsection of a corresponding top sheet membrane 104, wherein the track 118 is constructed with a pair of laterally facing channels 120. Alternatively, in FIG. 3B, first and second tracks 118 can extend along opposite edges of the top sheet membrane 104. The top sheet membrane 104 is provided with one or more tracks 118. Each track 118 has one or a pair of respective channels 120 that open laterally and slidably receive the edges 102*a*, 102*a* of a corresponding pair of the bottom sheet membranes 102, 102. Because the bottom sheet membranes 102, 102 are attached to respective pavement sections 106, 106, they undergo movement with the pavement sections 106, 106 as the pavement sections 106, 106 undergo thermal expansion and contraction. The edges 102*a*, 102*a* are moveable by being slidable in the respective channels 120 in response to movement of the respective pavement sections 106, 106, while the top sheet membrane 104 remains substantially stationary. Thus, each top sheet membrane 100 has one or more tracks 118 slidably coupled to at least two bottom sheet membranes 102, 102.

According to a feature of the invention, the combined movement of the two pavement sections 106, 106, due to contraction and expansion, is transferred to, and distributed among, the number of bottom sheet membranes 102. For example, when the present invention includes two bottom sheet membranes 102, 102, the combined movement of the two pavement sections 106, 106 is distributed among the two bottom sheet membranes 102, 102. Thus, the movement of each bottom sheet membrane 102 relative to the stationary top sheet membrane 104 is one-half of the combined movement of the two pavement sections 106, 106.

As disclosed by FIG. 4, the present invention further includes one or more additional bottom sheet membranes 102, in addition to the one pair of bottom sheet membranes 102, 102 on corresponding pavement sections 106, 106. Each of the additional bottom sheet membranes 102 is moveable along a channel 120 of a track 118 on at least one corresponding top sheet membrane 104. Thus, the combined movement of the two pavement sections 106, 106, due to contraction and expansion, is distributed among the number of bottom sheet membranes 102 that are included in the membrane assembly 100. Advantageously, to reduce the total displacement of each bottom sheet membrane 102 due to thermal movement of the pavement sections 106, 106, one or more additional bottom sheet membranes 102 can be added to the membrane assembly 100.

Further, the present invention extends to include more than one top sheet member 104, to distribute the combined movement of the two pavement sections 106, 106 among more than one top sheet member 104. Each additional top sheet membrane 104 has a track 118 that slidably receives the edges of at least two bottom sheet members. Advantageously, to reduce the total displacement of each bottom sheet membrane 102 relative to a corresponding top sheet member 104, one or more additional top sheet membranes 104 can be added to the membrane assembly 100.

With continued reference to FIGS. 1 and 2, the top sheet membrane 104 is adapted to support road surfacing material 112 thereon. The top sheet membrane 104 of the membrane assembly 100 isolates the road surfacing material 112 from movement of the pavement sections 104, 108 to resist cracks from developing in the road surfacing material 112.

When the roadway 118 is resurfaced, hot road surfacing material 112, is heated as high as about 350° F. Conventional paving machinery spreads and compacts the hot material 112 to form a surface layer covering the roadway 108 and the membrane assembly 100. The composition of the hot asphalt mix consolidates, as it cools down within a consolidation temperature range of about 300° F. to about 180° F. Thereafter, the top sheet membrane 104 remains substantially stationary to isolate the road surfacing material 112 from movement of the respective pavement sections 106, 106. Further, the membrane assembly 100 advantageously deters the formation of cracks in the road surfacing material 112 due to expansion and contraction of the pavement sections 106, 106.

According to the present invention, the membrane assembly 100 is covered by the hot asphalt mix and must have a melting temperature higher than that of the hot road surfacing material 112. According to an embodiment of the present invention, each of the sheet membranes 102, 104 is made as a stiffly flexible, flat plate having a composition of high strength reinforcing fibers in a solidified thermoplastic matrix, wherein the thermoplastic matrix has a melt temperature higher than that of the hot road surfacing material 112. For example, each of the sheet membranes 102, 104 is made from a precursor comprising a reinforcement fabric that is commercially available under the brand name, TWINTEX® from Saint-Gobain Technical Fabrics America, Inc. Each of the sheet membranes 102, 104 comprises 40% to 60% reinforcing glass fibers interlaced with one another, and interlaced with solidified rovings including, but not limited to, fibers, yarns or segments, which have been melted, partially or fully, while under pressure, and re-solidified to join with the glass fibers. The rovings include any of the polymeric materials that are capable of melting and forming a bond with the glass fibers when re-solidified, including, but not limited to, polypropylene, polyethylene, polystyrene, and other suitable thermoplastic resins and thermosetting resins, such as B-stage resins. Each of the sheet membranes 102, 104 is consolidated and rendered semi-rigid or rigid, by having the thermoplastic rovings re-melted and secured to the glass fibers under pressure.

According to the invention, each the sheet membranes 102, 104 is made by heating the fabric to melt the polymeric material, followed by cooling to solidify and bond the polymeric material with the glass fibers. Each of the sheet membranes 102, 102, 104 is fully consolidated, by having the melted, and thereafter, re-solidified polymeric material bonded to the reinforcing fibers. Further, the sheet membranes 102, 102, 104 are fully consolidated, stiffly flexible, flat plates that are slidable against one another when assembled in the membrane assembly 100. For example, each is stiffly flexible, flat plate of about one-eighth inch to on-quarter inch thick, and is stiffly flexible to conform to an irregular flatness of the roadway 108.

Figure 5:
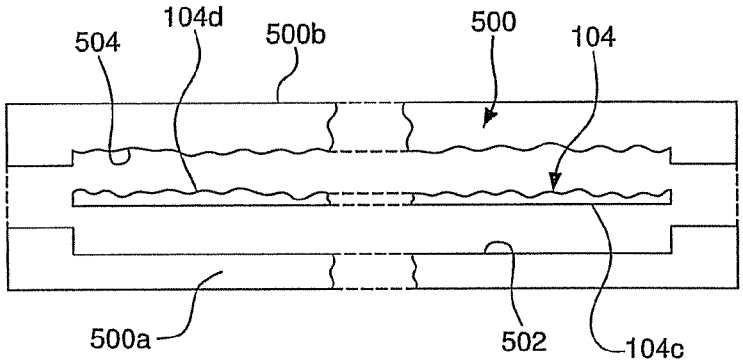
FIG. 5 is a schematic view of a top membrane sheet formed by a mold die.

As disclosed by FIG. 5, the top sheet membrane 104 is formed between two halves 500*a*, 500*b* of a mold die 500 under the application of heat and pressure. The top sheet membrane 104 is formed with a substantially smooth bottom surface 104*c*, by being formed against a smooth surface 502 of a bottom half 500*a* of the mold die 500. Alternatively, after being formed in the mold die 500, the bottom surface 104*c* is formed by a thin layer of a low friction material, such as, polytetrafluroethylene, having a melting temperature exceeding or greater than the temperature of the hot asphalt mix of the surface layer 112. The smooth bottom surface 104*c* reduces friction when the top sheet membrane 104 slides against each bottom sheet membrane 102. Further, the top sheet membrane 104 is formed with a top surface 104*d* having a substantially rough surface topography by being formed against a rough surface 504 of the top half 500*b* of the mold die 500. The rough surface topography enhances adherence of the top sheet membrane 104 to the road surfacing material 112.

According to an embodiment of the road surfacing material 112, a hot asphalt-based road surfacing material, is typically 110° C. and higher, and consolidates, for example, by cooling down within a temperature range of about 300° F. and about 170° F., to form a unified structure. The hot asphalt-based road surfacing material can be spread and compacted directly on the membrane assembly 100. However, according to another embodiment of the road surfacing material 112, the hot asphalt-based road surfacing material is applied over a stress absorbing underlayment in the form of a self-adhesive reinforced membrane that bonds directly onto the membrane assembly 100 and the roadway 108. The reinforced membrane is commercially available under the brand name, GlasGrid® from Saint-Gobain Technical Fabrics America, Inc. Durable waterproofing of the roadway is provided by a visco-elastic bond of the GlasGrid® reinforced membrane.

Another embodiment of the road surfacing material 112 includes a stress absorbing underlayment in the form of a composite reinforcing system, commercially available under the brand name, CompoGrid™ a product supplied, for example, by Saint-Gobain Technical Fabrics Canada, Ltd. A composite reinforcing membrane includes a GlasGrid® reinforced membrane covered with a non-woven paving fabric. Before overlaying with hot asphalt-based road surfacing material, the CompoGrid™ membrane is saturated with a hot sprayed, polymer modified, bituminous asphalt binder, for example, a binder commercially available under the brand name Sealoflex® a product supplied, for example, by Saint-Gobain Technical Fabrics Canada, Ltd.

Another embodiment of the road surfacing material 112 includes a stress absorbing underlayment in the form of a composite reinforcing system, commercially available under the brand name, GridSeal® supplied, for example, by Saint-Gobain Technical Fabrics America, Inc. The composite reinforcing system includes a GLASGRID® reinforced membrane covered with hot sprayed, bituminous asphalt binder, for example, a binder commercially available under the brand name Sealoflex® supplied, for example, by Ooms Avenhorn Holding BV, of The Netherlands. The binder is followed by a layer of crushed aggregate, and a top layer of hot asphalt-based road surfacing material.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method of making a membrane assembly for embedding in road surfacing material, comprising:

forming at least a pair of bottom sheet membranes and at least one top sheet membrane as respective plates having interlaced high strength fibers consolidated in a polymeric matrix, wherein the polymeric matrix has a melting temperature higher than a temperature of hot asphalt mix, and wherein the bottom sheet membranes are adapted to attach and cover respective pavement sections of a roadway, and wherein the top sheet membrane is adapted to support a road surfacing material thereon; and constructing each top sheet membrane with a track, wherein each track receives edges of a corresponding pair of the bottom sheet membranes.

2. The method of claim 1, further comprising:

forming a roughened surface on each top sheet membrane, wherein the roughened surface supports the road surfacing material.

3. The method of claim 1, further comprising:

forming a smooth bottom surface on each top sheet membrane, wherein the smooth bottom surface slidably engages a corresponding pair of the bottom sheet membranes.

4. The method of claim 1, further comprising:

adding one or more additional top sheet membranes to the membrane assembly.

5. The method of claim 1, further comprising:

adding one or more additional bottom sheet membranes to the membrane assembly; and adding one or more additional top sheet membranes to the membrane assembly, wherein each additional top sheet membrane has at least one track receiving a corresponding edge of an additional bottom sheet membrane.

* * * * *